US006122899A

United States Patent [19]

Söderling

[11] Patent Number: 6,122,899

[45] Date of Patent: Sep. 26, 2000

[54] METHOD FOR AUTOMATICALLY INSERTING ARTICLES INTO ENVELOPES AND AN APPARATUS FOR APPLYING SAID METHOD

[75] Inventor: Peter Söderling, Delägargatan, Sweden

[73] Assignee: Plockmatic International AB, Stockholm-Globen, Sweden

[21] Appl. No.: 09/144,051

[22] Filed: Aug. 31, 1998

[30] Foreign Application Priority Data

Sep. 2, 1997 [SE] Sweden ..... 9703153

[51] Int. Cl.[7] ..... B65B 11/48

[52] U.S. Cl. ..... 53/460; 53/569; 53/381.7

[58] Field of Search ..... 53/460, 569, 284.3, 53/381.7

[56] References Cited

U.S. PATENT DOCUMENTS

| | | | |
|---|---|---|---|
| 3,550,351 | 12/1970 | Gombault | 53/569 |
| 5,042,223 | 8/1991 | Gerbaud . | |
| 5,301,935 | 4/1994 | Miki et al. | 53/569 X |
| 5,339,603 | 8/1994 | Gombault | 53/284.3 X |
| 5,408,811 | 4/1995 | Satake | 53/569 |
| 5,415,068 | 5/1995 | Marzullo | 53/284.3 X |

FOREIGN PATENT DOCUMENTS

| | | |
|---|---|---|
| WO9513197 | 5/1995 | European Pat. Off. . |
| 0781671 | 7/1997 | European Pat. Off. . |
| 0825037 | 2/1998 | European Pat. Off. . |
| 2183214 | 6/1987 | United Kingdom . |
| 2284793 | 6/1995 | United Kingdom . |
| 2284794 | 6/1995 | United Kingdom . |
| WO9728972 | 8/1997 | WIPO . |

*Primary Examiner*—Linda Johnson
*Attorney, Agent, or Firm*—Laff, Whitesel & Saret, Ltd.; J. Warren Whitesel

[57] ABSTRACT

A method and apparatus for automatically filling and sealing envelopes in a complete sequence starting with envelopes being placed in an initial position and terminating with filled envelopes being delivered fully prepared for being labelled and stamped. The novel feature is turning the envelopes from a position with their front sides facing downwards into a position with their reverse sides facing downwards, with the contents of the envelopes being introduced when they are in the last-mentioned position. In consequence of the invention a faster operating and considerably more compact apparatus can be attained than in the prior art.

3 Claims, 4 Drawing Sheets

METHOD FOR AUTOMATICALLY INSERTING ARTICLES INTO ENVELOPES AND AN APPARATUS FOR APPLYING SAID METHOD

FIELD OF THE INVENTION

This invention refers to a method for automatically inserting articles into envelopes in a complete sequence and to apparatus for applying said method. The method and apparatus are based on a unique concept utilizing a combination of a plurality of functions in specific sequential order, wherein the method and apparatus fulfill such objectives as reducing the size and improving the efficiency of the apparatus and making the latter highly cost effective, thereby greatly outdistancing methods and apparatus of the prior art.

BACKGROUND OF THE INVENTION

Apparatus for automatically inserting articles into envelopes may be used for example to introduce documents intended for forwarding by mail into an envelope which subsequently, if desired, can be supplemented with additional documents or articles and later can be sealed. Further, the envelope into which articles have been inserted can be delivered from the apparatus ready to be labelled and stamped. Normally this is done in a plurality of individual machines.

Requirements to be fulfilled by an apparatus of the relevant type are i.a. that it is to be convenient to operate and that the infeed and outfeed positions are to be placed at the same level and behind copiers which for example may be found in passageways in major corporations so that the apparatus for inserting articles, for example documents produced by a copier, will be readily accessible to whoever needs it. The requirement of a copier associated with the mentioned plurality of individual machines required to form a complete system leads to an elongate total apparatus, which is not desirable when the apparatus is to be positioned as indicated above, and hence a reduction in the size of the apparatus would represent a great advantage.

SUMMARY OF THE INVENTION

The object of the invention is to disclose a method and an apparatus for automatically inserting articles into envelopes in a complete sequence and to do this in manner to achieve an apparatus that is extremely fast-operating and that is very compact, i.e. is much shorter in length than apparatus known in the prior art.

It may also be mentioned that an envelope feeder is utilized for separating envelopes in a pile and that said feeder is adjustable for various envelope sizes. Apart from the mentioned adjustment and adjustment for various paper sizes all further positioning is carried out completely automatically.

Despite a high degree of automatic processing the apparatus of the invention, as noted above, has reduced dimensions and is very compact, and its capacity is substantial in relation to its size, for example filling 3600 envelopes per hour in contrast to possibly filling approximately 2000 envelopes an hour in the prior art. The apparatus of the invention operates at high speed and the cost of it is low. The reduced dimensions of the apparatus and its high operating speed are to a considerable extent results of a novel way of turning the envelopes from the inlet side of the apparatus to its outlet side with the additional advantage being achieved, that the front side of the envelope faces upwards when exiting the apparatus. All of this is attained by utilizing the method of the invention.

Specifically, the apparatus is flexible with regard to the size of envelopes and it can utilize envelopes ranging from the size of 6×9 inches to 14×14 inches.

Practical advantages are that envelopes may be loaded into the apparatus when the latter is in operation and that as mentioned above the envelopes have their faces upwards when they leave the apparatus, thereby not only gaining the advantage that the flap of the envelope is subjected to pressure by the weight of the envelope itself and by the contents of the envelope so that the latter will be more tightly sealed but also the advantage that subsequent processing, for example labelling and stamping, can be performed with greater ease when the envelope is delivered in proper position from the apparatus.

The method of utilizing the apparatus for inserting not only documents but also other articles, for example CD-ROMs, into envelopes so as to automatically fill and subsequently seal the envelopes, and the apparatus itself, are defined in the accompanying claims.

BRIEF DESCRIPTION OF THE DRAWINGS

The apparatus for inserting articles, for example documents, into envelopes in accordance with the invention will be described more specifically with reference to the accompanying drawings, in which.

The same reference numerals have been used in the various figures wherever possible.

DETAILED DESCRIPTION OF A PREFERRED EMBODIMENT

Figure 1:
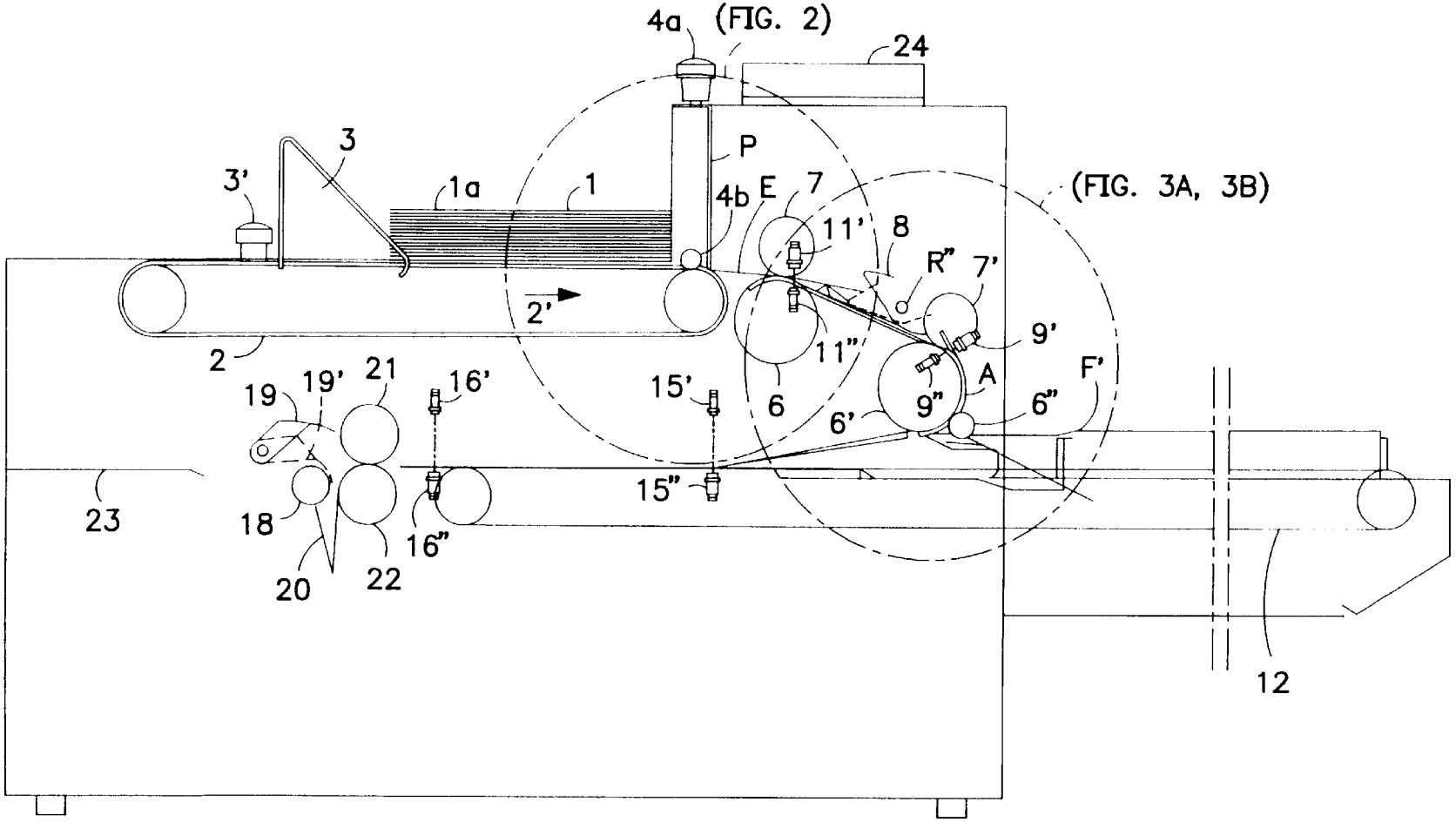
FIG. 1 shows an elevational view of a simplified apparatus in accordance with the invention with solely the essential portions illustrated and with annular markings showing corresponding enlarged additional figures for reasons of clarity, viz.
Figure 2:
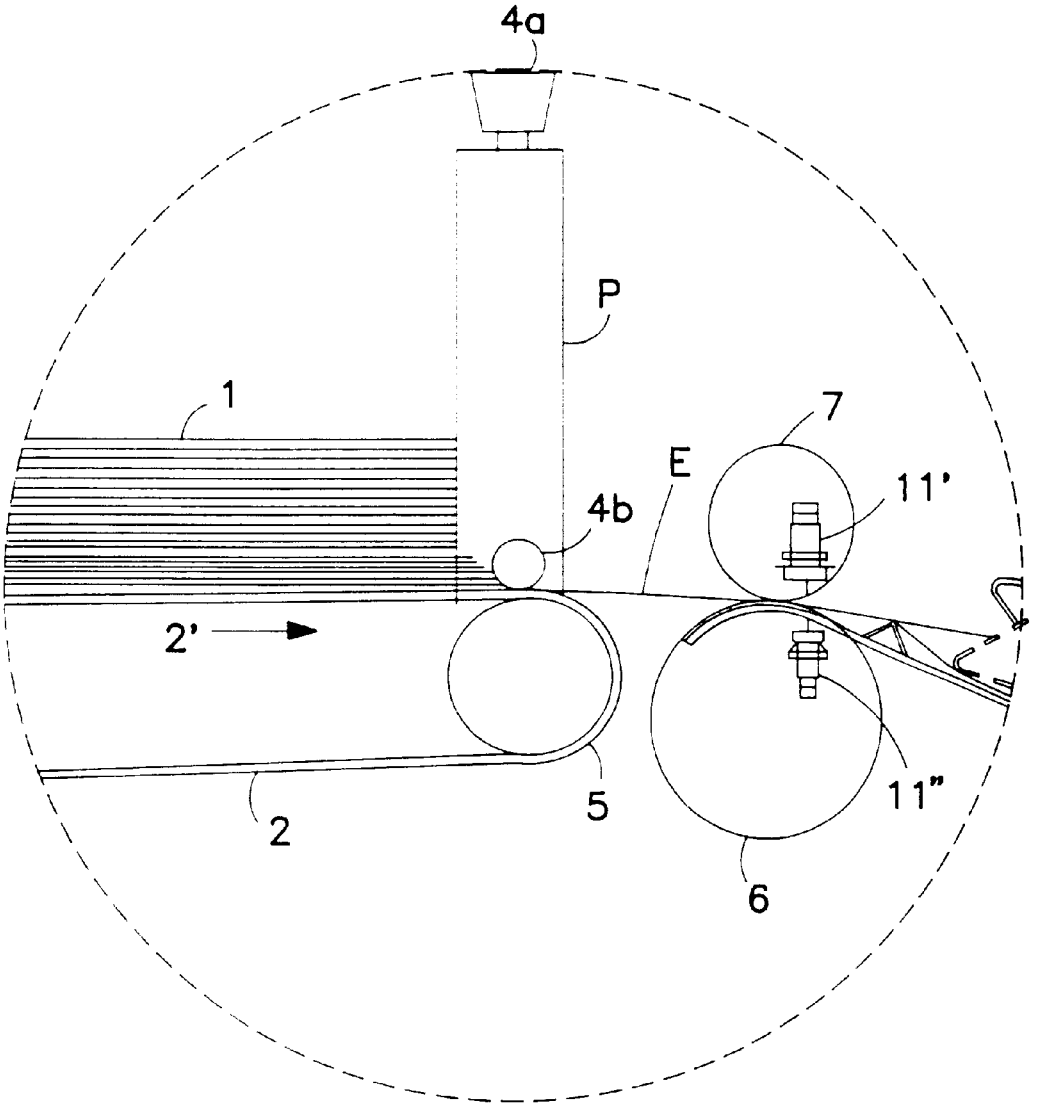
FIG. 2, which shows an enlargement of the intermediate portion of FIG. 1, and FIGS. 3A and 3B, respectively, which show enlarged portions of the mechanisms for opening the flaps of the envelopes in sequence and for advancing the envelopes one by one and concurrently changing their positions so that the front sides of the envelopes will face upwardly, whereas the reverse sides will face downwardly. The envelopes will at that time be in position for insertion of their contents.

In FIGS. 1 and 2 the designation 1 refers to a pile of envelopes positioned on one or more parallel conveyor belts 2 in manner known per se. In this specific case it will be assumed that there are two conveyor belts 2. A rear envelope abutment 3 may to advantage be included so that the envelopes will lie evenly against the conveyor belts 2. The envelope abutment 3 may be secured in position by means of a clamping device with a knob 3'.

An envelope separating arrangement is marked out by a first dot-dash circle in FIG. 1 and is shown in greater detail in FIG. 2. It comprises a foremost envelope engagement post P and a conventional separating roller 4*b* whose position may be set by a positioning mechanism 4*a* on the post P at the end of the conveyor belts 2 in their envelope advancing direction which is indicated by an arrow 2'. When the upper runs of the conveyor belts move forward (in the direction of arrow 2'), the foremost and lowermost envelope E is separated from the pile of envelopes and is advanced from the pile of envelopes through the conventional separating arrangement. The gap between the separating roller 4*b* and the foremost feed roller 5 of the conveyor belts is of exactly such size that only one single envelope may pass through it at a time. In the illustrated initial position as viewed in FIGS. 1 and 2 the envelopes 1 are disposed with their front sides facing downwards and with respective flaps 1*a* closed (but not sealed) and having their reverse sides facing upwards. This positioning is of great significance for the further processing of the envelopes.

After the separated envelope has entered the gap between the separating roller 4*b* and the feed roller 5 it is advanced by the conveyor belts 2 in manner to introduce its base end between a first positioning roller 6 and a rider roller 7. The first positioning roller 6 is powered and pulls the envelope between upper and lower sensors 11' and 11", thereby providing an indication that the first end of the envelope, i.e. the base end, has passed between them.

Figure 3A:
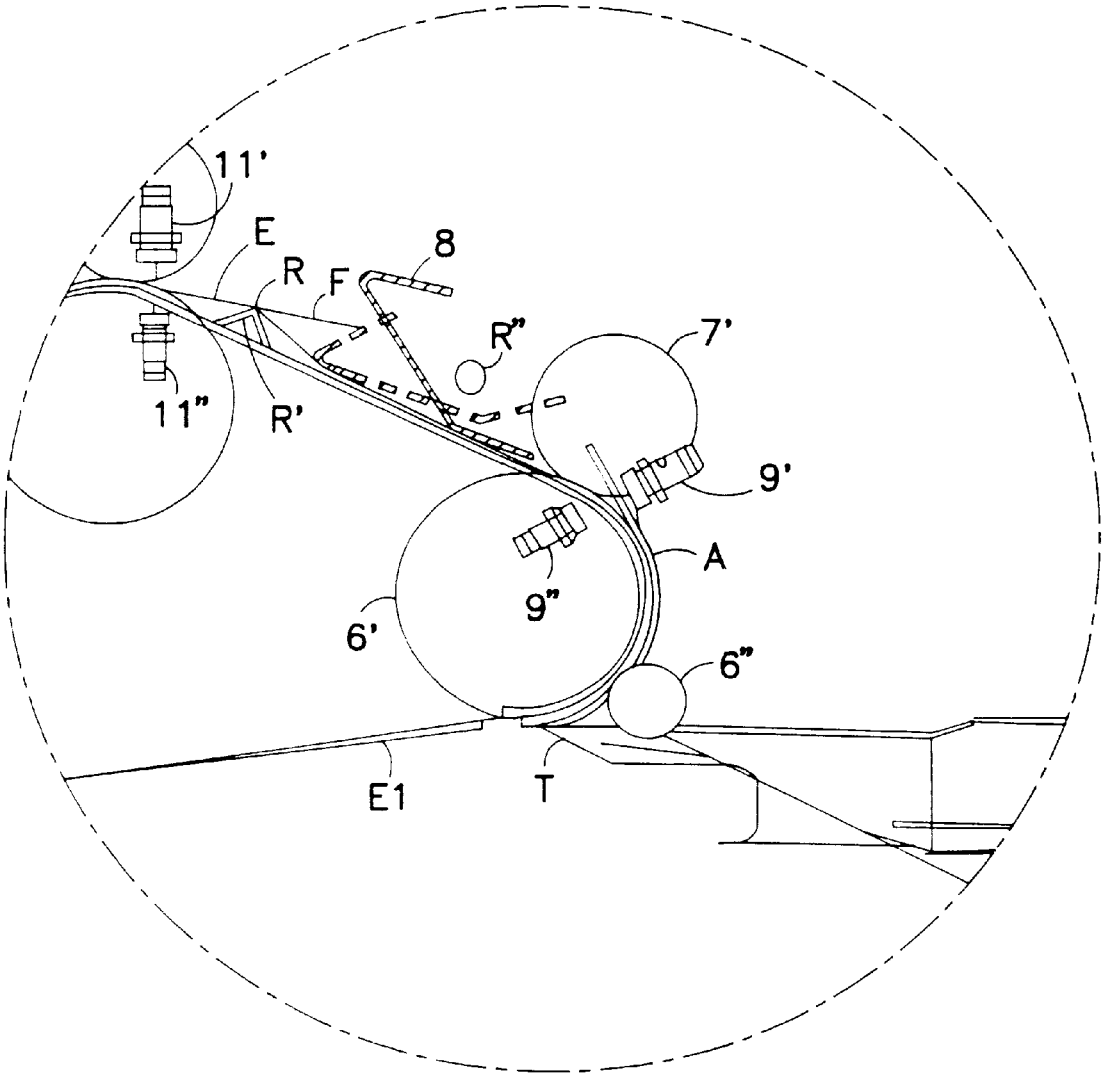
Figure 3B:
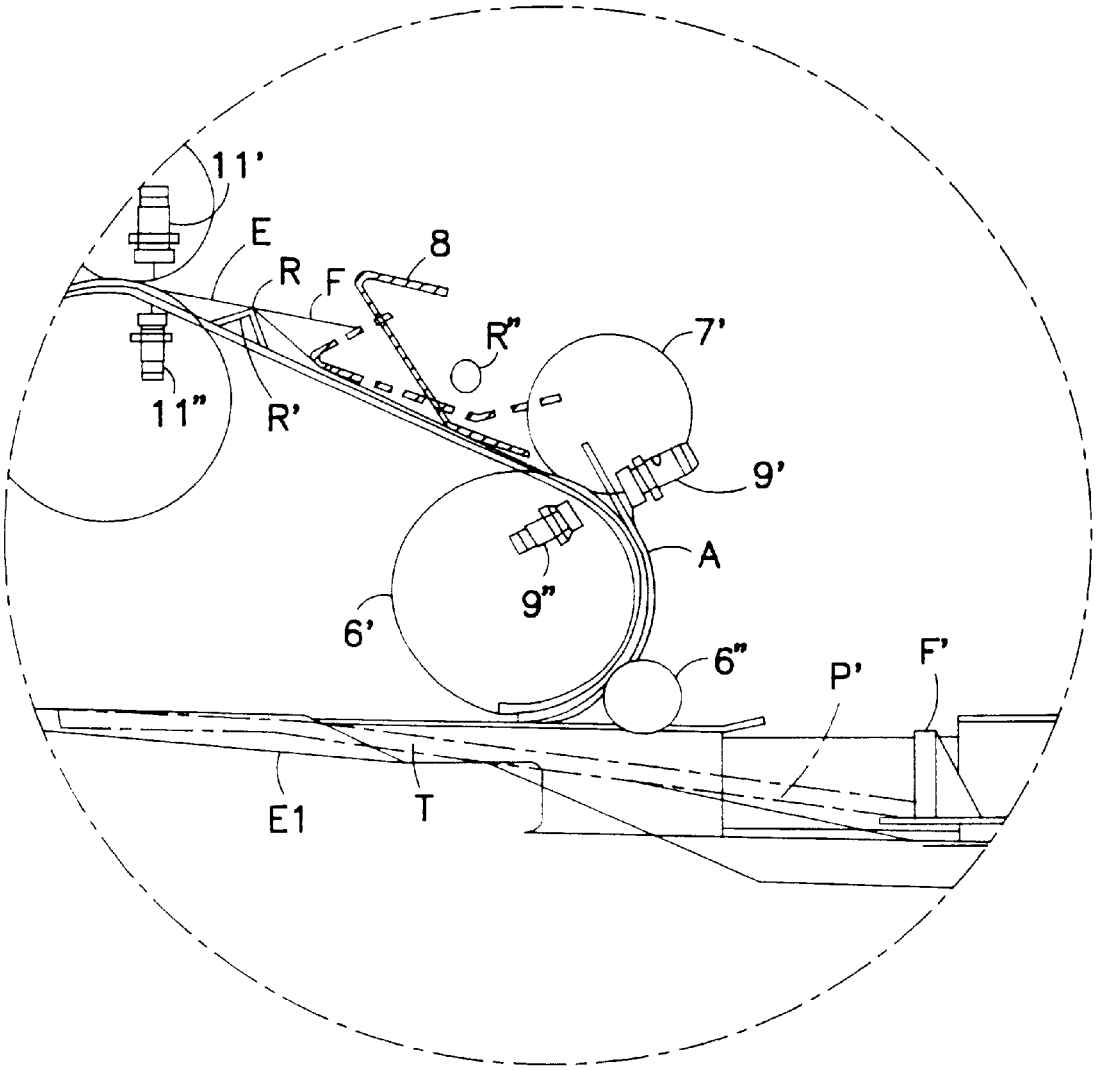

A second dot-dash circle in FIG. 1 is shown in greater detail in FIGS. 3A and 3B, respectively. FIG. 3A shows the front side of the envelope E engaging the top R of an elongate rib R' having a length equal to the width of the envelope, with the envelope having continued on to a flap opener 8 in the form of a plate with at least the same width as the envelope. The flap opener 8 is shown in one position marked with solid lines and in another position marked with dashed lines in FIGS. 1, 3A and 3B. The flap opener is rotatable about an axis R". The position of the flap opener 8 marked in solid lines represents the initial position, whereas the position marked in dashed lines represents the flap opener when it has been swung downwards around axis R", thereby successively opening the flap which is designated F. More specifically, the flap opener is designed similarly to a hook in elevational view and the base end of the envelope passes under the lower portion of the flap opener on to a drive roller 7' opposite to a second powered positioning roller 6' and under a curved plate A and is advanced further by interaction between a rider roller 10 and positioning roller 6' after passing the upper end of said curved plate A so as to have its feed direction changed by approximately 180°. The designation 6" refers to a roller which engages the envelope through an opening in said curved plate A for ensuring that the envelope is advanced properly. The halt position of the envelope can be determined in conventional manner on the basis of an indication by for example sensors 9' and 9", pulse generators, or a stepping motor or by mechanical means. At the end of its movement around the positioning roller 6' the front side of the envelope faces upwards, the flap is open with its adhesive side facing downwards, and the envelope is ready to accept its future contents delivered for each envelope in conventional manner from a feeding device, for example a copier, or manually on the right hand side.

The right hand end of FIG. 1 shows a conveyor belt 12 on which for example single sheets, batches of documents or even CD-ROMs to be inserted into the envelope are advanced in sequence.

FIG. 3A shows a tool T which is to be introduced into the envelope E1 preceding the one presently on positioning roller 6' to open the bow of the envelope E1 downwardly whereby for example a set of papers indicated by P' in FIG. 3B may be introduced from the underneath side of the envelope by being pushed by a feed dog F' on conveyor belt 12. Conveyor belt 12 continues to forward the envelope to a sealing station 14. Two pairs of sensors 15' and 15" and 16' and 16", respectively, are disposed along conveyor belt 12. Sensors 15' and 15" sense that an envelope is in proper position for continued processing, whereas sensors 16' and 16" initiate the sealing sequence.

The latter is done by the envelope being forwarded between rollers 21 and 22 (FIG. 1) in a sealing unit until said envelope passes a moisturizing roller 18, whereafter it stops. Subsequently the envelope is reversed and a flap guide 19 is brought down to a position 19' so as to guide the flap into a flap pocket 20. Thereafter guide 19 is raised and the envelope flap is reversed between the sealing rollers 21 and 22 with adhesive on the flap being urged against the moisturizing roller 18 and the envelope being sealed when the flap enters between rollers 21 and 22 a second time, whereafter the envelope is advanced out of the apparatus on a plate 23 for labelling and stamping by appropriate means.

In FIG. 1 the designation 24 refers to a display and a keyset for operator communication.

The invention is not limited to the embodiment described above and illustrated in the drawings, as this embodiment solely shows an example of the invention and its mode of application.

What is claimed is:

1. A method of automatically filling and sealing envelopes in preparation for labeling and stamping by using apparatus for supplying inserts for envelopes in a complete sequence, said method comprising the steps of:

advancing envelopes one by one from a pile of envelopes with a front side of the envelope facing downwardly and with an envelope flap facing upwardly, said flap being closed but not sealed, said advancing being controlled by means selected from a group consisting of sensors, pulse generators, a stepping motor, or by mechanical means for enabling a filling of envelopes of various sizes, opening the flap of the envelope by a flap opener, advancing the envelope with its front side around a roller co-operating with a curved guide plate for changing the feed direction of the envelope by approximately 180°, thereby positioning the envelope with its front side facing upwardly and its reverse side facing downwardly, halting the envelope, ensuring that the envelope is open, introducing an insert selected from a group consisting of one document, a plurality of documents, or a CD-ROM, there being a straight line flow of inserts into the opened envelope, advancing the envelope to a sealing device, reversing the envelope and guiding its flap into a pocket, moistening and sealing the flap, reversing the envelope between sealing rollers with the flap closed, delivering the envelope with its front side facing upwardly, and labeling and stamping the envelope.

2. Apparatus for automatically filling and sealing envelopes in a complete sequence, said apparatus successively comprising means for enabling a feeding of envelopes of various sizes, an envelope separating device, a flap opening device, an envelope turnover device, a device for introducing an insert into said envelope, and a sealing and feed-out device, respectively, wherein the envelope feeding device comprises mutually parallel conveyor belts, the envelope separating device comprises a positionable separating roller at a forward end of the conveyor belts, the flap opening device comprises a rotatable plate, the envelope turnover device comprises at least one means from a group consisting of sensors, pulse generators, a stepping motor, or mechanical means and a roller in cooperation with an associated curved guide plate, the device for introducing an insert comprising means for inserting inserts in a straight line flow into said envelopes, said inserts being selected from a group consisting of a document, a plurality of documents, or a CD-ROM, said device for introducing an insert including an envelope opening tool, and the sealing device comprising feeding rollers, a moisturizing roller, a flap guide, a flap pocket, sealing rollers, and feedout rollers for labeling and stamping said envelope.

3. The apparatus of claim 2 and means after said feedout rollers for labeling and stamping said envelope.

* * * * *